US006992049B2

(12) United States Patent
Deckman et al.

(10) Patent No.: US 6,992,049 B2
(45) Date of Patent: Jan. 31, 2006

(54) LUBRICATING OIL COMPOSITIONS

(75) Inventors: Douglas E. Deckman, Mullica Hill, NJ (US); William L. Maxwell, Pilesgrove, NJ (US); William H. Buck, West Chester, PA (US); Mark D. Winemiller, Clarksboro, NJ (US); David J. Baillargeon, Cherry Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 234 days.

(21) Appl. No.: 10/353,168

(22) Filed: Jan. 28, 2003

(65) Prior Publication Data

US 2003/0195128 A1 Oct. 16, 2003

Related U.S. Application Data

(60) Provisional application No. 60/353,771, filed on Jan. 31, 2002.

(51) Int. Cl.
*C10M 127/06* (2006.01)
*C10M 143/00* (2006.01)

(52) U.S. Cl. ..... 508/591; 585/10; 585/13; 585/26

(58) Field of Classification Search ..... 508/591
See application file for complete search history.

(56) References Cited

U.S. PATENT DOCUMENTS

| | | | | |
|---|---|---|---|---|
| 4,604,491 | A * | 8/1986 | Dressler et al. | 585/26 |
| 4,714,794 | A * | 12/1987 | Yoshida et al. | 585/26 |
| 5,146,021 | A | 9/1992 | Jackson et al. | 508/10 |
| 5,171,904 | A * | 12/1992 | Sanderson et al. | 585/10 |
| 5,595,966 | A * | 1/1997 | Rees et al. | 508/591 |
| 5,602,086 | A | 2/1997 | Le et al. | 508/591 |
| 5,658,865 | A * | 8/1997 | Yoshida et al. | 508/501 |
| 5,883,057 | A | 3/1999 | Roell, Jr. et al. | 508/469 |
| 6,180,575 | B1 * | 1/2001 | Nipe | 508/227 |
| 6,239,085 | B1 * | 5/2001 | Slack | 508/539 |
| 6,713,438 | B1 * | 3/2004 | Baillargeon et al. | 508/463 |
| 6,869,917 | B2 * | 3/2005 | Deckman et al. | 508/110 |

FOREIGN PATENT DOCUMENTS

| | | |
|---|---|---|
| EP | 06 04408 A1 | 6/1994 |
| WO | WO0058423 | 10/2000 |

* cited by examiner

*Primary Examiner*—Ellen M. McAvoy
(74) *Attorney, Agent, or Firm*—Norby L. Foss; Joseph J. Dvorak

(57) ABSTRACT

The present invention provides a viscosity index improving lubricant additive which comprises an olefinic oligomer of about 2,000 to about 20,000 number average molecular weight having a viscosity of 75 to about 3,000 cSt at 100° C. and a hydrocarbyl aromatic which contains at least about 5% of its weight from aromatic moieties having a viscosity of about 3 to about 50 cSt at 100° C. where the weight ratio of hydrocarbyl aromatic component to olefin oligomer is from about 1:2 to about 50:1. In another aspect, the invention provides for a lubricating oil composition comprising a base oil and the instant viscosity index improving additive.

11 Claims, 1 Drawing Sheet

Viscosity Index Enhancement At Differing Ratios Of Olefin Oligomer And Hydrocarbon Base Stock.

Figure 1. Viscosity Index Enhancement At Differing Ratios Of Olefin Oligomer And Hydrocarbon Base Stock.
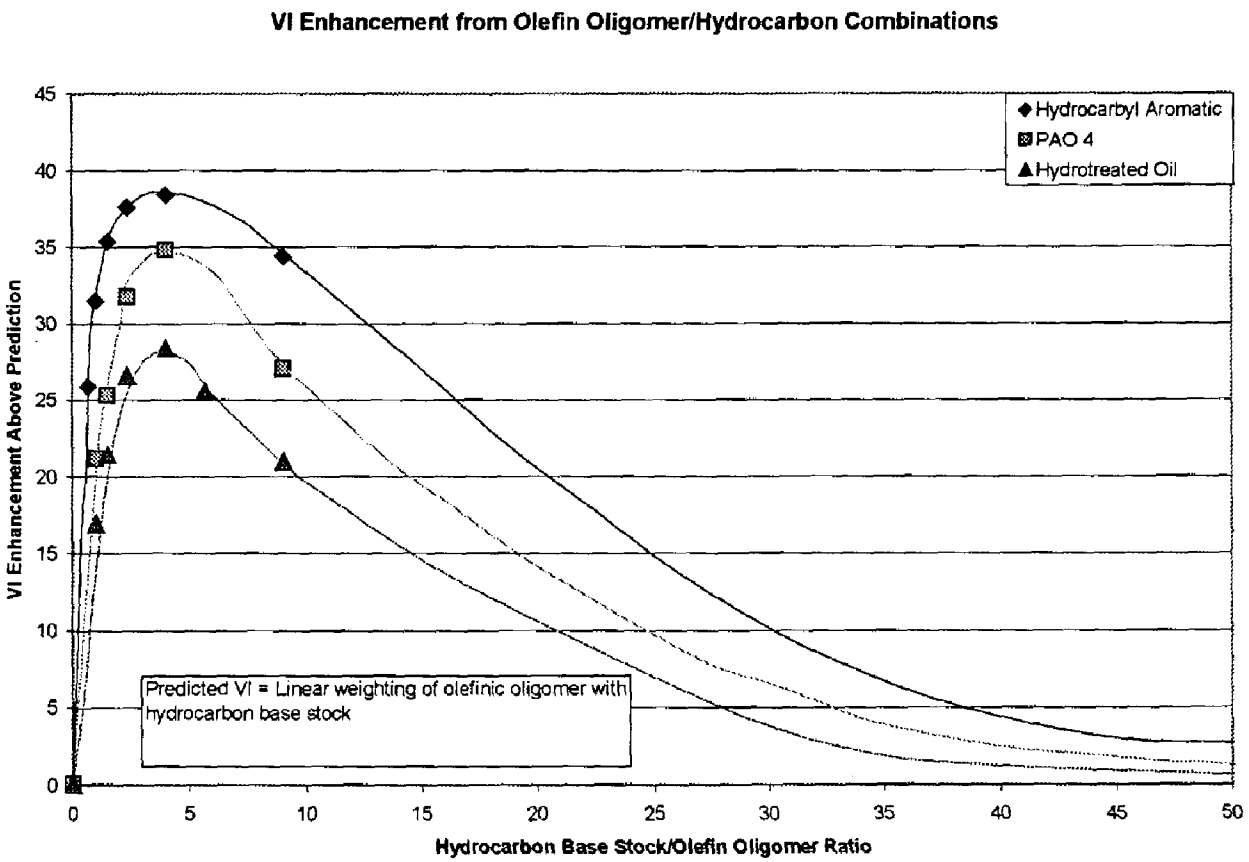

LUBRICATING OIL COMPOSITIONS

CROSS-REFERENCE TO RELATED APPLICATION(S)

Non-Provisional Application based on Provisional Application 60/353,771 filed Jan. 31, 2002.

BACKGROUND OF THE INVENTION

1. Field of the Invention

This invention relates to lubricating oil compositions suitable for use in internal combustion engines.

2. Background

Contemporary lubricants such as engine oils use mixtures of additives such as dispersants, detergents, inhibitors, viscosity index improvers and the like to provide engine cleanliness and durability under a wide range of performance conditions of temperature, pressure, and lubricant service life.

It is critical to maintain sufficiently high viscosity at high operating temperatures to maintain a minimum lubricant film to minimize component wear. It is also critical to maintain a low, low-temperature viscosity to prevent excessive low-temperature oil thickening and to provide for satisfactory low-temperature operation. Viscosity index improvement can be a measure of such high- and low-temperature performance.

A variety of polymeric viscosity index improving components are used in various lubricating fluids to provide the necessary cross-grading to maintain fluid durability at high temperatures and to provide low viscosity at low temperatures to enhance low-temperature starting and low-temperature operation engine operation. These materials include high molecular weight hydrocarbons, polyesters and viscosity index improver dispersants that function as both a viscosity index improver and a dispersant. In particular, compositions such as styrene-diene copolymers, polymethacrylates, radial isoprene polymers, mixed olefin copolymers such as those chosen from the group consisting of ethylene-propylene copolymers and functionalized derivatives thereof are known. Many of the polymeric components used in the past have had deficiencies associated with the chemistry of the polymers such as shear instability and cleanliness properties. Additionally, the response of some of these added components are not as desirable as required for critical high performance considerations. Thus, there is a need for improved viscosity index improving materials.

SUMMARY OF THE INVENTION

The present invention provides a viscosity index enhancing lubricant additive which comprises an olefin oligomer of about 2,000 to about 20,000 number average molecular weight and a viscosity of about 75 to about 3,000 cSt at 100° C. and a hydrocarbyl aromatic which contains at least about 5% of its weight from aromatic moieties and a viscosity of about 3 to about 50 cSt at 100° C. where the weight ratio of hydrocarbyl aromatic component to olefin oligomer is from about 1:2 to about 50:1. In another aspect, the invention provides for a lubricating oil composition comprising a base oil and the instant viscosity index enhancing additive.

BRIEF DESCRIPTION OF THE DRAWINGS

FIG. 1 is a plot of the viscosity index enhancement for viscosity index enhancing compositions with differing ratios of olefin oligomer and other hydrocarbon base stock.

DETAILED DESCRIPTION OF THE INVENTION

Engine oils contain a base lube oil and a variety of additives. These additives include detergents, dispersants, friction reducers, viscosity index improvers, antioxidants, corrosion inhibitors, antiwear additives, pour point depressants, seal compatibility additives, anti-corrosion, and anti-foam agents. To be effective, these additives must be oil-soluble or oil-dispersible. By oil-soluble, it is meant that the compound is soluble in the base oil or lubricating oil composition under normal blending or use conditions.

In a first aspect the invention relates to a viscosity index improver additive composition. Viscosity index improvers (also known as VI improvers, viscosity modifiers, and viscosity improvers) provide lubricants with high and low-temperature operability. These additives impart favorable viscosity index number enhancement and shear stability at elevated temperatures and acceptable viscosity at low temperatures.

The viscosity index improver additives of the present invention are mixtures of olefin oligomers and hydrocarbyl aromatics. It is found that within narrow concentration ranges, a significant viscosity index enhancement occurs. In particular, a synergistic effect on Viscosity Index enhancement is seen for a ratio of approximately 1:1 to approximately 20:1 of hydrocarbyl aromatic(s): olefin oligomer. More preferred, depending upon application and the presence or absence of other components, is a ratio of about 1:1 to about 10:1. A ratio of 1:1.5 to about 10:1 is preferred depending upon the application. Depending upon other components, and performance needs, ratios of about 1:2 to a 50:1 could be more advantageously used.

Another aspect of this invention is a means to provide an unexpected increase in high-temperature high-shear (HTHS) viscosity when combining hydrocarbyl aromatics with olefin oligomers. An olefin oligomer is combined separately with a hydrocarbyl aromatic base stock, a 4 cSt PAO base stock, and a hydroprocessed base stock in a series of ratios. Kinematic viscosity (KV, as determined by ASTM D 445) at 40° C. and 100° C., HTHS viscosity (ASTM D 4683) at 150° C. and density at 150° C. (ASTM D 4052) are measured for all mixtures. The measured HTHS viscosity is compared to the predicted HTHS viscosity. Predicted HTHS viscosity is determined by extrapolating the KV at 40° C. and KV at 100° C. viscosity measurements for a sample to 150° C. per ASTM D 341 and multiplying this result by the sample density at 150° C. The HTHS enhancement is then determined by subtracting the predicted HTHS viscosity from the measured HTHS viscosity. For mixtures containing hydrocarbyl aromatics and the olefin oligomer, there is an unexpected and significant HTHS enhancement. The HTHS enhancement for the hydrocarbyl aromatic/olefin oligomer mixtures is greater than that observed for the mixtures of olefin oligomer with either 4 cSt PAO or hydroprocessed base stock. This indicates that there is a synergy when hydrocarbyl aromatics are combined with olefin oligomers.

Another aspect of this invention is that when the olefin oligomer is added to hydrocarbyl aromatics, PAO, or hydroprocessed base stock, the resulting mixture surprisingly has Newtonian high-temperature and low-temperature viscometric properties, providing significant additional potential performance characteristics to the instant invention.

The hydrocarbyl aromatics that can be used can be any hydrocarbyl molecule that contains preferably at least about 5% of its weight derived from an aromatic moiety such as a benzenoid moiety or naphthenoid moiety, or their derivatives. This can include hydrocarbyl aromatics such as alkyl benzenes, alkyl naphthalenes, alkyl diphenyl oxides, alkyl naphthols, alkyl phenols, alkyl diphenyl sulfides, alkylated bis-phenol A, and the like. The aromatic can be mono-alkylated, dialkylated, polyalkylated, and the like. As further examples, alkylbenzenes (dodecylbenzenes, tetradecylbenzenes, dinonylbenzenes, di(2-ethylhexyl)benzenes, for example); polyphenyls (biphenyls, terphenyls, alkylated polyphenyls, for example); alkylated naphthalene ($C_{16}$ alkyl naphthalene, for example); alkylated diphenyl ethers; and alkylated diphenyl sulfides and the derivatives, analogs, and homologs thereof and the like. Functionalization can thus be as mono- or poly-functionalized. As examples above show, the aromatic group can contain non-hydrocarbon material, thus the term "hydrocarbyl" in "hydrocarbyl aromatic" refers only to the substituent. The hydrocarbyl groups can also be comprised of mixtures of alkyl groups, alkenyl groups, alkynyl, cycloalkyl groups, cycloalkenyl groups and other related hydrocarbyl groups, and can optionally also contain S, N, and/or O. Typically the hydrocarbyl group is a long chain alkyl group with about 8 or more carbons, typically containing about 14 or more carbons, with about 16 or more carbons on occasion being more preferred. Viscosities at 100° C. of approximately 3 cSt to about 50 cSt are often desirable, with viscosities of approximately 3.4 cSt to about 20 cSt often being preferred.

Alkylated aromatics such as the hydrocarbyl aromatics of the present invention may be produced by well-known Friedel-Crafts alkylation of aromatic compounds. See *Friedel-Crafts and Related Reactions*, Olah, G. A. (ed), Inter-science Publishers, New York, 1963. For example, an aromatic compound, such as benzene or naphthalene, is alkylated by an olefin, alkyl halide or alcohol in the presence of a Friedel-Crafts catalyst. See *Friedel-Crafts and Related Reactions*, Vol. 2, part 1, chapters 14, 17, and 18, See Olah, G. A. (ed), Inter-science Publishers, New York, 1964. Many homogeneous or heterogeneous, solid catalysts are known to one skilled in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Newer alkylation technology uses zeolites or solid super acids.

Certain combinations of alkylated aromatics and PAOs are described in U.S. Pat. No. 5,602,086.

The high viscosity olefin oligomer can be derived from alpha-olefins such as octene, decene, dodecene, tetradecene, hexadecene and the like, alone or as mixtures of these and other olefins. The oligomer should be oligomerized to form molecular weight components, as measured by number average molecular weight of at least 2,000 up to about a number average molecular weight of approximately 20,000. More preferably, a number average molecular weight of approximately 2,500 to about 10,000 can be more preferred. At times, a number average molecular weight range of 2,500 to about 7,000 can be most preferred. A fluid having a viscosity at 100° C. of approximately 75 to 3,000 cSt is desirable, with 100 to about 1,500 cSt often being preferred, with about 100 to 1,000 cSt being more preferred. Mw ranges of approximately 4,000 to approximately 50,000 or more can be used to advantage. Typical high viscosity olefin oligomers have Mw/Mn ranges of approximately 1.1 to about 5 or more, with ranges of 1.5 to about 4 often preferred, with ranges of about 1.7 to about 3 often most preferred, depending upon the lubricant into which is formulated along with a hydrocarbyl aromatic. Mixtures may be used to advantage.

In another aspect, the present invention concerns a lubricating oil composition containing the present viscosity index enhancing composition. The viscosity index enhancing composition of this invention can advantageously be used at a total concentration of about 3% to about 40% in a paraffinic lubricating oil base stock or a mixture of lubricating oil base stocks having a combined viscosity index of approximately 110 or greater. Concentrations of such synergistic components can more preferably range from approximately 5% to about 20%, or more preferably from about 6% to about 18% by weight. Group II and/or Group III hydroprocessed or hydrocracked base stocks and similar base stocks such as those described herein when used in lubricants comprised of such synergistic viscosity index enhancing components are greatly preferred over polyalphaolefin lubricating base stocks when used in conjunction with the components of this invention. At least 20% of the total composition should consist of such Group II or Group III base stocks, with 30%, on occasion being more preferable, and 48% on occasion being even more preferable. Wax-derived hydroisomerized-type base oils, such as wax-isomerate and gas-to-liquid base stocks, can also be preferentially used with the components of this invention. We believe that the improvement and benefit is best when the components of this invention are added to lubricating systems comprised of primarily Group II and or Group III base stocks rather than when added to fluids comprised primarily of synthetic fluids such as those derived using decene, dodecene and or tetradecene trimers and tetramers fluids.

A wide range of lubricating oils is known in the art. Lubricating oils that are useful in the present invention are both natural oils and synthetic oils. Natural and synthetic oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve the at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used.

Groups I, II, III, IV and V are broad categories of base oil stocks developed and defined by the American Petroleum Institute (API Publication 1509; www.API.org) to create guidelines for lubricant base oils. Group I base stock generally have a viscosity index of between about 80 to 120 and contains greater than about 0.03% sulfur and/or less than about 90% saturates. Group II base stocks generally have a viscosity index of between about 80 to 120, and contain less than or equal to about 0.03 % sulfur and greater than or equal to is about 90% saturates. Group III stock generally has a viscosity index greater than about 120 and contain less than or equal to about 0.03 % sulfur and greater than about 90% saturates. Group IV includes polyalphaolefins (POA). Group V base stock includes base stocks not included in Groups I–IV. The table below summarizes properties of each of these five groups.

Base Stock Properties

| | Saturates | Sulfur | Viscosity Index |
|---|---|---|---|
| Group I | <90 &/or | >0.03% & | ≧80 & <120 |
| Group II | ≧90 & | ≦0.03% & | ≧80 & <120 |
| Group III | ≧90 & | ≦0.03% & | ≧120 |
| Group IV | Defined as polyalphaolefins (PAO) | | |
| Group V | All other base oil stocks not included in Groups I, II, III, or IV | | |

Natural oils include animal oils, vegetable oils (castor oil and lard oil, for example), and mineral oils. Animal and vegetable oils possessing favorable thermal oxidative stability can be used. Of the natural oils, mineral oils can be preferred. Mineral oils vary widely as to their crude source, for example, as to whether they are paraffinic, naphthenic, or mixed paraffinic-naphthenic. Oils derived from coal or shale are also useful in the present invention. Natural oils vary also as to the method used for their production and purification, for example, their distillation range and whether they are straight run or cracked, hydrorefined, or solvent extracted.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, ethylene-alphaolefin copolymers, for example). Polyalphaolefin (PAO) oil base stocks are a commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073 which are incorporated herein by reference in their entirety.

The number average molecular weights of the PAOs, which are known materials and generally available from suppliers such as ExxonMobil Chemical Company, Chevron-Phillips, BP-Amoco, and others, typically vary from about 250 to about 3,000, although PAO's may be available in viscosities up to about 100 cSt (100° C.). The PAOs typically comprise relatively low molecular weight hydrogenated polymers or oligomers of alphaolefins which include, but are not limited to, about $C_2$ to about $C_{32}$ alphaolefins with about $C_8$ to about $C_{16}$ alphaolefins, such as 1-octene, 1-decene, 1-dodecene, mixtures thereof, and the like being preferred. The preferred polyalphaolefins are poly-1-octene, poly-1-decene, poly-1-dodecene, mixtures thereof, and mixed olefin derived polyolefins, although the dimers of higher olefins in the range of about $C_{14}$ to $C_{18}$ may be used to provide low viscosity base stocks of acceptably low volatility. The PAOs generally have a viscosity in the range of from about 1.5 to 12 cSt at 100° C. and are generally predominantly trimers and tetramers of the starting olefins, with lesser amounts of higher oligomers also present.

The PAO fluids may be conveniently made by the polymerization of an alphaolefin in the presence of a polymerization catalyst such as Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. Nos. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330. Each of the aforementioned patents is incorporated by reference herein in its entirety.

Other useful synthetic lubricating base stock oils may also be utilized, for example those described in the seminal work *"Synthetic Lubricants"*, Gunderson and Hart, Reinhold Publ. Corp., New York 1962 which is incorporated herein in its entirety.

In alkylated aromatic stocks, the alkyl substituents typically are alkyl groups having from about 8 to 25 carbon atoms, and preferably from about 10 to 18 carbon atoms. Any number of such substituents may be present, although no more than 3 such groups generally are preferred. See, for example, ACS Petroleum Chemistry Preprint 1053–1058, *"Poly n-Alkylbenzene Compounds: A Class of Thermally Stable and Wide Liquid Range Fluids"*, Eapen et al, Phila. 1984. Tri-alkyl benzenes may be produced by the cyclodimerization of 1-alkynes of 8 to 12 carbon atoms as described in U.S. Pat. No. 5,055,626. Other alkylbenzenes are described in European Patent Application No. 168 534 and U.S. Pat. No. 4,658,072. Alkylbenzenes have been used as lubricant base stocks, especially for low temperature applications (arctic vehicle service and refrigeration oils) and in papermaking oils. They are commercially available from producers of linear alkylbenzenes (LABs) such as Vista Chem. Co, Huntsman Chemical Co., as well as Chevron Chemical Co., and Nippon Oil Co. The linear alkylbenzenes typically have good low pour points and low temperature viscosities and VI values greater than 100 together with good solvency for additives. Other alkylated aromatics which may be used are described in *"Synthetic Lubricants and High Performance Functional Fluids"*, Dressler, H., chap 5, (R. L. Shubkin (Ed.)), Marcel Dekker, N.Y. 1993. Each of the afore noted disclosures is incorporated by reference herein in its entirety.

Other useful lubricant oil base stocks include wax isomerate base stocks and base oils, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks and base oils, and other wax isomerate hydroisomerized base stocks and base oils, or mixtures thereof. Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, incorporated herein in its entirety by reference. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359, also incorporated herein by reference. Particularly favorable processes are described in European Patent Application Nos. 464546 and 464547, also incorporated herein. Processes using Fischer-Tropsch wax feeds are described in U.S. Pat. Nos. 4,594,172 and 4,943,672, incorporated herein by reference in its entirety. Gas-to-Liquids (GTL) base oils, Fischer-Tropsch wax derived base oils, and other wax-derived hydroisomerized (wax isomerate) base oils be advantageously used in the instant invention, and may have useful kinematic viscosities at 100° C. of about 3 cSt to about 50 cSt, preferably about 3 cSt to about 30 cSt, more preferably about 3.5 cSt to about 25 cSt, as exemplified by GTL 4 with kinematic viscosity of about 4.0 cSt at 100° C. and a viscosity index of about 141. These Gas-to-Liquids (GTL) base oils, Fischer-Tropsch wax derived base oils, and other wax-derived hydroisomerized base oils may have useful pour points of about −20° C. or lower, and under some conditions may have advantageous pour points of about −25° C. or lower, with useful pour points of about −30° C. to about −40° C. or lower. Useful compositions of Gas-to-Liquids (GTL) base oils, Fischer-Tropsch wax derived base oils, and wax-derived hydroisomerized base oils are recited in U.S. Pat. Nos. 6,080,301; 6,090,989, and 6,165,949 for example, and are incorporated herein in their entirety by reference.

Gas-to-Liquids (GTL) base oils, Fischer-Tropsch wax derived base oils, have a beneficial kinematic viscosity advantage over conventional Group II and Group III base oils, which may be very advantageously used with the instant invention. Gas-to-Liquids (GTL) base oils can have significantly higher kinematic viscosities, up to about 20–50 cSt at 100° C., whereas by comparison commercial Group II base oils can have kinematic viscosities, up to about 15 cSt at 100° C., and commercial Group III base oils can have kinematic viscosities, up to about 10 cSt at 100° C. The higher kinematic viscosity range of Gas-to-Liquids (GTL) base oils, compared to the more limited kinematic viscosity range of Group II and Group III base oils, in combination with the instant invention can provide additional beneficial advantages in formulating lubricant compositions. Also, the exceptionally low sulfur content of Gas-to-Liquids (GTL) base oils, and other wax-derived hydroisomerized base oils, in combination with the low sulfur content of suitable olefin oligomers and/or alkyl aromatics base oils, and in combination with the instant invention can provide additional advantages in lubricant compositions where very low overall sulfur content can beneficially impact lubricant performance.

Alkylene oxide polymers and interpolymers and their derivatives containing modified terminal hydroxyl groups obtained by, for example, esterification or etherification are useful synthetic lubricating oils. By way of example, these oils may be obtained by polymerization of ethylene oxide or propylene oxide, the alkyl and aryl ethers of these polyoxyalkylene polymers (methyl-polyisopropylene glycol ether having an average molecular weight of about 1000, diphenyl ether of polyethylene glycol having a molecular weight of about 500–1000, and the diethyl ether of polypropylene glycol having a molecular weight of about 1000 to 1500, for example) or mono- and polycarboxylic esters thereof (the acidic acid esters, mixed $C_{3-8}$ fatty acid esters, or the $C_{13}$Oxo acid diester of tetraethylene glycol, for example).

Esters comprise a useful base stock. Additive solvency and seal swell characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, and the like, with a variety of alcohols such as butyl alcohol, hexyl alcohol, dodecyl alcohol, 2-ethylhexyl alcohol, and the like. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate and dieicosyl sebacate.

Particularly useful synthetic esters are those which are obtained by reacting one or more polyhydric alcohols, preferably the hindered polyols such as the neopentyl polyols e.g. neopentyl glycol, trimethylol ethane, 2-methyl-2-propyl-1,3-propanediol, trimethylol propane, pentaerythritol and dipentaerythritol with alkanoic acids containing at least about 4 carbon atoms (for example, $C_5$ to $C_{30}$ acids such as saturated straight chain fatty acids which include caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any such components).

Preferred synthetic ester components are the esters of trimethylol propane, trimethylol butane, trimethylol ethane, pentaerythritol and/or dipentaerythritol with one or more monocarboxylic acids containing from about 5 to about 10 carbon atoms. Such esters, including for example, Mobil P-41 and P-51 esters are available from ExxonMobil Chemical Company.

Silicon-based oils are another class of useful synthetic lubricating oils. These oils include polyalkyl-, polyaryl-, polyalkoxy-, and polyaryloxy-siloxane oils and silicate oils. Examples of suitable silicon-based oils include tetraethyl silicate, tetraisopropyl silicate, tetra-(2-ethylhexyl)silicate, tetra-(4-methylhexyl) silicate, tetra-(p-tert-butylphenyl) silicate, hexyl-(4-methyl-2-pentoxy) disiloxane, poly(methyl) siloxanes, and poly-(methyl-2-mehtylphenyl) siloxanes.

Another class of synthetic lubricating oil is esters of phosphorous-containing acids. These include, for example, tricresyl phosphate, trioctyl phosphate, diethyl ester of decanephosphonic acid.

Another class of oils includes polymeric tetrahydrofurans, their derivatives, and the like.

Although the benefit of the viscosity index improver may be optimal when the improver is added to an engine oil comprising primarily Group II and/or Group III base stocks or wax isomerate base stock, lower concentrations of co-base stocks can also advantageously be combined with the viscosity index improvers of the invention. These co-base stocks, as described above, include dibasic acid esters, polyol esters, other hydrocarbon oils, and the like. These co-base stocks can also include Group IV synthetic fluids (such as alphaolefin-derived trimers and tetramers) and also Group I base stocks, provided that the engine oil comprises at least about 50%, by weight, of Group II and/or Group III type base stocks or wax isomerate base stocks.

Other Lubricating Oil Components

The instant invention can be used with performance additives such as for example, but not limited to, oxidation inhibitors, metallic and non-metallic dispersants, metallic and non-metallic detergents, corrosion and rust inhibitors, metal deactivators, anti-wear agents (metallic and non-metallic, phosphorus-containing and non-phosphorus, sulfur-containing and non-sulfur types), extreme pressure additives (metallic and non-metallic, phosphorus-containing and non-phosphorus, sulfur-containing and non-sulfur types), anti-seizure agents, pour point depressants, wax modifiers, viscosity modifiers, seal compatibility agents, friction modifiers, lubricity agents, anti-staining agents, chromophoric agents, defoamants, demulsifiers, and others. For a review of many commonly used additives see Klamann in *Lubricants*

*and Related Products*, Verlag Chemie, Deerfield Beach, Fla.; ISBN 0-89573-177-0, which gives a good discussion of a number of the lubricant additives discussed mentioned below. Reference is also made *"Lubricant Additives"* by M. W. Ranney, published by Noyes Data Corporation of Parkridge, N.J. (1973).

Antiwear and EP Additives

Internal combustion engine lubricating oils require the presence of antiwear and/or extreme pressure (EP) additives in order to provide adequate antiwear protection for the engine. Increasingly demanding specifications for engine oil performance have required increasing antiwear properties of the oil. Antiwear and EP additives perform this role by reducing friction and wear of metal parts.

While there are many different types of antiwear additives, for several decades the principal antiwear additive for internal combustion engine crankcase oils has been a metal alkylthiophosphate and more particularly a metal dialkyldithiophosphate in which the primary metal constituent is zinc, or zinc dialkyldithiophosphate (ZDDP). Popular ZDDP compounds are of the formula $Zn[SP(S)(OR^1)(OR^2)]_2$ where $R^1$ and $R^2$ are $C_1$–$C_{18}$ alkyl groups, preferably $C_2$–$C_{12}$ alkyl groups, including mixtures of such groups. These alkyl groups may be straight chain or branched, and derived from primary and/or secondary alcohols and/or alkaryl groups such as alkyl phenol. The ZDDP typically is used in amounts of from about 0.2 to 2 weight %, preferably from about 0.5 to 1.5 weight %, more preferably from about 0.7 to 1.4 wt % of the total lube oil composition, although more or less can often be used.

However, it has been found that the phosphorus from these additives has a deleterious effect on the catalyst in catalytic converters and also on oxygen sensors in automobiles. One way to minimize this effect is to replace some or all of the ZDDP with phosphorus-free antiwear additives.

A variety of non-phosphorous additives are also useful as antiwear and EP additives, including for example, sulfurized olefins. Sulfur-containing olefins can be prepared by sulfurization of various organic materials including aliphatic, arylaliphatic or alicyclic olefin hydrocarbons containing from about 3 to 30 carbon atoms, preferably from about 3–20 carbon atoms. The olefinic compounds contain at least one non-aromatic double bond. Such compounds are defined by the formula:

$$R^3R^4C{=}CR^5R^6$$

where each of $R^3$–$R^6$ are independently hydrogen or a hydrocarbon radical. Preferred hydrocarbon radicals are alkyl or alkenyl radicals. Any two of $R^3$–$R^6$ may be connected so as to form a cyclic ring. Additional information concerning sulfurized olefins and their preparation can be found in U.S. Pat. No. 4,941,984 incorporated herein by reference in its entirety.

The use of polysulfides of thiophosphorous acids and thiophosphorous acid esters as lubricant additives is disclosed in U.S. Pat. Nos. 2,443,264; 2,471,115; 2,526,497; and 2,591,577. Addition of phosphorothionyl disulfides as an antiwear, antioxidant, and EP additive is disclosed in U.S. Pat. No. 3,770,854. Use of alkylthiocarbamoyl compounds (bis(dibutyl)thiocarbamoyl, for example) in combination with a molybdenum compound (oxymolybdenum diisopropylphosphorodithioate sulfide, for example) and a phosphorous ester (dibutyl hydrogen phosphite, for example) as antiwear additives in lubricants is disclosed in U.S. Pat. No. 4,501,678. U.S. Pat. No. 4,758,362 discloses use of a carbamate additive to provide improved antiwear and extreme pressure properties. The use of thiocarbamate as an antiwear additive is disclosed in U.S. Pat. No. 5,693,598. Thiocarbamate/molybdenum complexes such as moly-sulfur alkyl dithiocarbamate trimer complex (R=$C_8$–$C_{18}$ alkyl) are also useful antiwear agents. Each of the aforementioned patents is incorporated by reference herein in its entirety.

Esters of glycerol may be used as antiwear agents. For example, mono-, di, and tri-oleates, mono-palmitates and mono-myristates may be used.

ZDDP has been combined with other compositions that provide antiwear properties. U.S. Pat. No. 5,034,141 discloses that a combination of a thiodixanthogen compound (octylthiodixanthogen, for example) and a metal thiophosphate (ZDDP, for example) can improve antiwear properties. U.S. Pat. No. 5,034,142 discloses that use of a metal alkyoxyalkylxanthate (nickel ethoxyethylxanthate, for example) and a dixanthogen (diethoxyethyl dixanthogen, for example) in combination with ZDDP improves antiwear properties.

Preferred antiwear additives include phosphorus and sulfur compounds such as zinc dithiophosphates and/or sulfur, nitrogen, boron, molybdenum phosphorodithioates, molybdenum dithiocarbamates and various organo-molybdenum derivatives including heterocyclics (for example, dimercaptothiadiazoles, mercaptobenzothiadiazoles, triazines, and the like), alicyclics, amines, alcohols, esters, diols, triols, fatty amides and the like can also be used.

Such additive may be used in amounts ranging from about 0.01 to 6 weight %, preferably about 0.01 to 4 weight %.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, for example, Klamann op cite, and U.S. Pat. Nos. 4,798,684 and 5,084,197, incorporated herein by reference in their entirety.

Useful antioxidants include hindered phenols. These phenolic antioxidants may be ashless (metal-free) phenolic compounds or neutral or basic metal salts of certain phenolic compounds. Typical phenolic antioxidants are hindered phenolics that contain a sterically hindered hydroxyl group, and these include those derivatives of dihydroxy aryl compounds in which the hydroxyl groups are in the o- or p- position to each other. Typical phenolic antioxidants include hindered phenols substituted with about $C_6$+alkyl groups and alkylene coupled derivatives of such hindered phenols. Examples of phenolic materials of this type include 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful mono-phenolic antioxidants may include, for example, 2,6-di-alkyl-phenolic proprionic ester derivatives. Bis-phenolic antioxidants may also be advantageously used in combination with the invention. Examples of ortho coupled phenols include: 2,2'-bis(6-t-butyl-4-heptyl phenol); 2,2'-bis(6-t-butyl-4-octyl phenol); and 2,2'-bis(6-t-butyl-4-dodecyl phenol). Para coupled bis phenols include, for example, 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is saturated. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthyl-amines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants. Low sulfur peroxide decomposers are useful as antioxidants.

Another class of antioxidant used in lubricating oil compositions is oil-soluble copper compounds. Any oil-soluble suitable copper compound may be blended into the lubricating oil. Examples of suitable copper antioxidants include copper dihydrocarbyl thio or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Preferred antioxidants include hindered phenols, arylamines, low sulfur peroxide decomposers and other related components. These antioxidants may be used individually by type or in combination with one another.

Such additives may be used in amounts of from about 0.01 to 5 weight %, preferably from about 0.01 to 2 weight %, even more preferably from about 0.01 to 1 weight %.

Detergents

Detergents are commonly used in lubricating compositions. A typical detergent is an anionic material that contains a long chain oleophillic portion of the molecule and a smaller anionic or oleophobic portion of the molecule. The anionic portion of the detergent is typically derived from an organic acid such as a sulfur acid, carboxylic acid, phosphorous acid, phenol, or mixtures thereof The counter ion is typically an alkaline earth or alkali metal.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is generally desirable for at least some detergent to be overbased. Overbased detergents help neutralize acidic impurities produced by the combustion process and become entrapped in the oil. Typically, the overbased material has a ratio of metallic ion to anionic portion of the detergent of about 1.05:1 to 50:1 on an equivalent basis. More preferably, the ratio is from about 4:1 to about 25:1. The resulting detergent is an overbased detergent that will typically have a TBN of about 150 or higher, often about 250 to 450 or more. Preferably, the overbasing cation is sodium, calcium, or magnesium. A mixture of detergents of differing TBN can be used in the present invention.

Preferred detergents include the alkali or alkaline earth metal salts of sulfates, phenates, carboxylates, phosphates, and salicylates.

Sulfonates may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 carbon or more carbon atoms, more typically from about 16 to 60 carbon atoms.

Ranney in *"Lubricant Additives"* op cit discloses a number of overbased metal salts of various sulfonic acids which are useful as detergents/dispersants in lubricants. The book entitled *"Lubricant Additives"*, C. V. Smallheer and R. K. Smith, published by the Lezius-Hiles Co. of Cleveland, Ohio (1967), similarly discloses a number of overbased sulfonates which are useful as dispersants/detergents.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched about $C_1$–$C_{30}$ alkyl groups, preferably about $C_4$–$C_{20}$. Examples of suitable phenols include isobutylphenol, 2-ethylhexylphenol, nonylphenol, 1-ethyldecylphenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent, including elemental sulfur or sulfur halides, such as sulfur dichloride and the like, and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids.

Useful salicylates include long chain alkyl salicylates. One useful family of compositions is of the formula

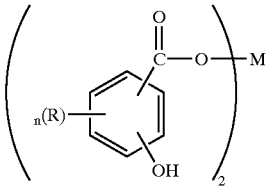

where R is a hydrogen atom or an alkyl group having 1 to about 30 carbon atoms, n is an integer from 1 to 4, and M is an alkaline earth metal. R may be optionally substituted with substituents that do not interfere with the detergent's function. M is preferably, calcium, magnesium, or barium, and more preferably, calcium and/or magnesium. Preferred are alkyl chains of at least about $C_{11}$, preferably about $C_{13}$ or greater.

Hydrocarbyl-substituted salicylic acids may be prepared from phenols by the Kolbe reaction. See U.S. Pat. No. 3,595,791, incorporated herein by reference in its entirety, for additional information on synthesis of these compounds. The metal salts of the hydrocarbyl-substituted salicylic acids may be prepared by double decomposition of a metal salt in a polar solvent such as water or alcohol.

Alkaline earth metal phosphates are also used as detergents.

Detergents may be simple detergents or what is known as hybrid or complex detergents. The latter detergents can provide the properties of two detergents without the need to blend separate materials. See, for example, U.S. Pat. No. 6,034,039 incorporated herein by reference in its entirety.

Preferred detergents include calcium phenates, calcium sulfonates, calcium salicylates, magnesium phenates, magnesium sulfonates, magnesium salicylates and other related components (including borated detergents).

Typically the total detergent concentration is from about 0.01 to 6 weight %, preferably from about 0.1 to 3 weight %, even more preferably from about 0.01 to 0.5 weight %.

Dispersant

During engine operation, oil insoluble oxidation byproducts are produced. Dispersants help keep these byproducts in solution, thus diminishing their deposit on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorous. Typical hydrocarbon chains contain about 50 to 400 carbon atoms.

Dispersants include phenates, sulfonates, sulfurized phenates, salicylates, naphthenates, stearates, carbamates, thiocarbamates, and phosphorus derivatives. A particularly useful class of dispersants are alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known. Exemplary U.S. Patents describing such dispersants include U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersants are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants is also found in European Patent Application No. 471 071. Each of the above noted patents and patent applications is incorporated herein by reference in its entirety.

Hydrocarbyl-substituted succinic acid compounds are well known dispersants. In particular, succinimide, succinate esters, or succinate ester amides prepared by the reaction of hydrocarbon-substituted succinic acid preferably having at least 50 carbon atoms in the hydrocarbon substituent, with at least one equivalent of an alkylene amine, are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; 3,652,616; 3,948,800; and Canada Pat. No. 1,094,044, each of which is incorporated by reference herein in its entirety.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpoly-amines and polyalkenylpolyamines such as polyethylene polyamines. One example is propoxylated hexamethylenediamine. Representative examples are shown in U.S. Pat. No. 4,426,305, incorporated by reference herein in its entirety.

The molecular weight of the alkenyl succinic anhydrides used in the preceding paragraphs will range between about 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product, including those derived from mono-succinimides, bis-succinimides (also known as disuccinimides), and mixtures thereof.

Mannich base dispersants are made from the reaction of alkylphenols, formaldehyde, and amines. See U.S. Pat. No. 4,767,551, incorporated by reference herein in its entirety. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039, which are incorporated herein by reference in its entirety.

Typical high molecular weight aliphatic acid modified Mannich condensation products useful in this invention can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600–100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, decaethylene undecamine, and mixtures of such amines. Some preferred compositions correspond to formula $H_2N—(Z—NH—)_nH$, where Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. Alkylene polyamines usually are obtained by the reaction of ammonia and dihalo alkanes, such as dichloro alkanes. Thus, the alkylene polyamines obtained from the reaction of 2 to 11 moles of ammonia with 1 to 10 moles of dichloro alkanes having 2 to 6 carbon atoms and the chlorines on different carbons are suitable alkylene polyamine reactants.

Aldehyde reactants useful in the preparation of the high molecular products useful in this invention include aliphatic aldehydes such as formaldehyde (such as paraformaldehyde and formalin), acetaldehyde and aldol (b-hydroxybutyraldehyde, for example). Formaldehyde or a formaldehyde-yielding reactant is preferred.

Hydrocarbyl substituted amine ashless dispersant additives are well known to those skilled in the art. See, for example, U.S. Pat. Nos. 3,275,554; 3,438,757; 3,565,804; 3,755,433, 3,822,209, and 5,084,197, each of which is incorporated by reference in its entirety.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine coupled Mannich adducts, their capped derivatives, and other related components. Such additives may be used in an amount of about 0.1 to 20 weight percent, preferably about 0.1 to 8 weight percent.

Pour Point Depressants

Conventional pour point depressants (also known as lube oil flow improvers) may be added to the compositions of the present invention if desired. These pour point depressants may be added to lubricating compositions of the present invention to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2.721,878; and 3,250,715 describe useful pour point depressants and/or the preparation thereof, and are incorporated herein by reference. Such additives may be used in an amount of about 0.01 to 5 weight percent, preferably about 0.01 to 1.5 weight percent.

Corrosion Inhibitors

Corrosion inhibitors are used to reduce the degradation of metallic parts that are in contact with the lubricating oil composition. Suitable corrosion inhibitors include thiadizoles and triazoles. See, for example, U.S. Pat. Nos. 2,719,125; 2,719,126; and 3,087,932, incorporated herein by reference in their entirety. Such additives may be used in an amount of about 0.01 to 5 weight percent, preferably about 0.01 to 1.5 weight percent.

Seal Compatibility Additives

Seal compatibility agents help to swell elastomeric seals. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 weight percent, preferably about 0.01 to 2 weight percent.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent and often less than 0.1 percent.

Inhibitors and Antirust Additives

Antirust additives (or corrosion inhibitors) are additives that protect lubricated metal surfaces against chemical attack by water or other contaminants. A wide variety of these are commercially available; they are referred to also in Klamann in *"Lubricants and Related Products"*, op. cit.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 weight percent, preferably about 0.01 to 1.5 weight percent.

Friction Modifiers

A friction modifier is any material or materials that can alter the coefficient of friction of any lubricant or fluid containing such material(s). Friction modifiers, also known as friction reducers, or lubricity agents or oiliness agents, and other such agents that change the coefficient of friction of lubricant base oils, formulated lubricant compositions, or functional fluids, may be effectively used in combination with the base oils or lubricant compositions of the present invention if desired. Friction modifiers that lower the coefficient of friction are particularly advantageous in combination with the base oils and lube compositions of this invention. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O , N, S, or P, individually or in combination. In particular, Mo-containing compounds can be particularly effective such as for example Mo-dithiocarbamates, Mo(DTC), Mo-dithiophosphates, Mo(DTP), Mo-amines, Mo (Am), Mo-alcoholates, Mo-alcohol-amides, etc.

Ashless friction modifiers may have also include lubricant materials that contain effective amounts of polar groups, for example hydroxyl-containing hydrocaryl base oils, glycerides, partial glycerides, glyceride derivatives, and the like. Polar groups in friction modifiers may include hyrdocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from about 0.01 wt % to 10–15 wt % or more, often with a preferred range of about 0.1 wt % to 5 wt %. Concentrations of molybdenum containing materials are often described in terms of Mo metal concentration. Advantageous concentrations of Mo may range from about 10 ppm to 3000 ppm or more, and often with a preferred range of about 20–2000 ppm, and in some instances a more preferred range of about 30–1000 ppm. Friction modifiers of all types may be used alone or in mixtures with the materials of this invention. Often mixtures of two or more friction modifiers, or mixtures of friction modifiers(s) with alternate surface active material(s), are also desirable.

Typical Additive Amounts

When lubricating oil compositions contain one or more of the additives discussed above, the additive(s) are blended into the composition in an amount sufficient for it to perform its intended function. Typical amounts of such additives useful in the present invention are shown in table below. However, the types and quantities of performance additives used in combination with the instant invention in lubricant compositions are not limited by the examples shown herein as illustrations.

Note that many of the additives are shipped from the manufacturer and used with a certain amount of processing oil solvent in the formulation. Accordingly, these weight amounts, as well as other amounts mentioned in this patent, are directed to the amount of active ingredient (that is the non-solvent, or non-diluent oil portion of the ingredient). The weight percents indicated below are based on the total weight of the lubricating oil composition.

TABLE 1

Typical Amounts of Various Lubricant Oil Components

| Compound | Approximate Weight Percent (Useful) | Approximate Weight Percent (Preferred) |
|---|---|---|
| Detergent | 0.01–6 | 0.01–4 |
| Dispersant | 0.1–20 | 0.1–8 |
| Friction Reducer | 0.01–5 | 0.01–1.5 |
| Viscosity Index Improver | 0.0–40 | 0.01–30, preferably 0.01–15 |
| Antioxidant | 0.01–5 | 0.01–1.5 |
| Corrosion Inhibitor | 0.01–5 | 0.01–1.5 |
| Anti-wear Additive | 0.01–6 | 0.01–4 |
| Pour Point Depressant | 0.0–5 | 0.01–1.5 |
| Anti-foam Agent | 0.001–3 | 0.001–0.15 |
| Base Oil | Balance | Balance |

EXAMPLES

The viscosity index enhancement for the following pairs of components is measured over a varied range of relative concentrations of base oils (a) Hydrocarbyl Aromatic, (b) PAO 4, and (c) HDT to Olefin Oligomer as shown as FIG. 1 and Table 2.

A series of blends of differing ratios of olefin oligomer and base stock are made, and the viscosity index enhancement from linearity is measured as shown in FIG. 1 and Table 2.

The olefin oligomer used is a polymer composition comprising a polymer of decene-1 possessing a viscosity at 100° C. of approximately 150 cSt, and a Mn=3,900, Mw=8,300 with a Mw/Mn=2.09. The hydrocarbyl aromatic used is alkylated naphthalene (primarily mono-alkylated) having a viscosity of approximately 4.7 cSt at 100° C., where the hydrocarbyl group is primarily $C_{16}$. The polyalphaolefin oil used is primarily trimers and tetramers of decene-1 having a viscosity of approximately 4 cSt at 100° C. The paraffinic oil used is a hydrotreated oil (Group II) having a viscosity of approximately 4.5 cSt at 100° C., and approximately 22.7 cSt at 40° C. Kinematic viscosities are measured by ASTM D 445.

The effect on viscosity index of differing ratios of different base oils to olefin oligomer is shown in Table 2 and FIG. 1.

At a 9:1 ratio of paraffinic base oils (Hydrotreated 4) to olefin oligomer, a 21-viscosity index number enhancement is noted. This enhancement peaks at a ratio of about 4:1 paraffinic base oils to olefin oligomer with a value of approximately 28. The degree of enhancement decreases at lower ratios.

At a 9:1 ratio of polyalphaolefin oil (PAO 4 sample) to olefin oligomer, a 27-viscosity index number enhancement is noted. This enhancement peaks at a ratio of about 4:1 polyalphaolefin base oil to olefin oligomer, with a value of approximately 35. The degree of enhancement then decreases at lower ratios.

At a 9:1 ratio of hydrocarbyl aromatic (hydrocarbyl aromatic sample) to olefin oligomer, a 34-viscosity index number enhancement is noted. This enhancement peaks at a ratio of about 4:1 hydrocarbyl aromatic to olefin oligomer with a value of about 38. These results for the hydrocarbyl aromatic are unexpected and significantly higher than those viscosity index number enhancements found for the above paraffinic oil and polyalphaolefin fluid cited above. In all examples, the degree of enhancement decreases at lower ratios, but remarkably the rate of decrease for the olefin oligomer and hydrocarbyl aromatic combination is much less than for the other mixtures.

TABLE 2

Viscosity Index Enhancement At Differing Ratios Of Base Stock To Olefin Oligomer

| Ratio of Base Stock/ Olefin Oligomer | in-fin-ity | 9.0 | 5.7 | 4.0 | 2.3 | 1.5 | 1.0 | 0.7 | 0.0 |
|---|---|---|---|---|---|---|---|---|---|
| Base Stock: | Viscosity Index Enhancement | | | | | | | | |
| Hydrocarbyl Aromatic (Comprising C16 alkylated naphthalene) | 0.0 | 34.4 | | 38.4 | 37.6 | 35.4 | 31.5 | 25.9 | 0.0 |
| PAO 4 | 0.0 | 27.0 | | 34.8 | 31.7 | 25.3 | 21.1 | | 0.0 |
| HDT 4 (Hydrotreated Base Oil) | 0.0 | 21.0 | 25.5 | 28.4 | 26.6 | 21.4 | 16.9 | | 0.0 |

These data clearly show the superiority of the olefin oligomer and hydrocarbyl aromatic mixture over the entire range of base stock to olefin oligomer ratios. For example, benefit is clearly derived from a ratio of about 1:2 to 50:1. The greatest benefit appearing at a ratio of approximately 1:1 to about 20:1, more so at about 1:1 to about 10:1 considering the hydrocarbyl aromatic:olefin oligomer combination.

TABLE 3

Typical Base Stock Properties

| | | HDT 4 | Hydrocarbyl Aromatic | PAO 4 | GpIII 4 |
|---|---|---|---|---|---|
| D445 | Kinematic Viscosity at 40° C., cSt | 22.65 | 29.3 | 18 | 15.6 |
| D445 | Kinematic Viscosity at 100° C., cSt | 4.55 | 4.7 | 4 | 3.8 |
| D2272 | Viscosity Index | 116 | 75 | 120 | 138 |
| D1500 | ASTM Color | L0.5 | 1.0 | 0 | 0 |
| D2007 | Saturates, wt % | 97 | na | 100 | na |
| D2622 | Sulfur, ppm | 60 | 150 | 0 | 0 |
| | API Group/Base Oil Classification | II | V | IV | III |

Lubricant compositions in Table 4 are examples of the instant invention, with such compositions not limiting the invention.

TABLE 4

| | Examples: | | | | | | | |
|---|---|---|---|---|---|---|---|---|
| | 4.1 | 4.2 | 4.3 | 4.4 | 4.5 | 4.6 | 4.7 | 4.8 |
| | Lubricant Compositions | | | | | | | |
| Ratio of Hydrocarbyl Aromatic/Olefin Oligomer | 40:1 | 4:1 | 1:1 | 40:1 | 4:1 | 1:1 | 20:1 | 10:1 |
| | Compositions | | | | | | | |
| Olefin Oligomer | 0.3 | 5 | 10 | 0.5 | 2 | 4.5 | 1 | 3 |
| Hydrocarbyl Aromatic | 12 | 20 | 10 | 20 | 8 | 4.5 | 20 | 30 |
| Dispersant/ Deterent/Inhibitor Performance Additive Package | 6 | 12 | 14 | 7 | 10 | 15 | 9 | 8 |
| PAO | | 10 | | Bal | 40 | Bal | | 30 |
| HDT 4 | | | Bal | 20 | Bal | | Bal | 20 |
| GpIII 4 | Balance | Bal | | | | | 40 | Bal |
| Ester (KV100 5.5 cSt; VI = 131) | | 6 | | 10 | | 2 | 2 | |
| 150 SUS SPN | 10 | | 5 | | 20 | 2 | | |

All U.S. patents, non-U.S. patents and applications, and non-patent references cited in this application are hereby incorporated in their entirety by reference.

What is claimed is:

1. A lubricating oil composition comprising:

(a) an oil of lubricating viscosity selected from the group consisting of Group II base stock, Group III base stock, Group IV base stock, and wax isomerates, and mixtures thereof; and (b) a lubricant additive in an amount of about 3% to about 40% of the weight of the lubricating oil composition, the additive comprising:

(i) an alkylated naphthalene which contains at least about 5% of its weight from the naphthenoid moiety and having a viscosity of about 3 to about 50 cSt at 100%:

(iii) an olefinic oligomer of about 2,000 to 20,000 number average molecular weight and having a viscosity of about 100 to 3,000 cSt at 100° C.; and wherein the weight ratio of component (i) to (ii) is from 1.5:1 to about 10:1.

2. The lubricating oil composition of claim 1 wherein the olefinic oligomer is an alpha olefin.

3. The lubricating oil of claim 2 wherein the alpha olefin has a viscosity of about 100 to 1,000 cSt at 100° C.

4. The lubricating oil composition of any one of claim 1–3 wherein the oil of lubricating viscosity contains at least 50 weight percent of at least one of Group II base stock, Group III base stocks, Group IV base stock, and wax isomerates, and mixtures thereof.

5. The lubricating oil composition of claim 4 wherein the amount of Group II base stock, Group III base stocks and wax isomerate base stock is at least 20 weight percent of the lubricating oil composition.

6. The lubricating oil composition of claim 5 wherein the amount of Group II base stock, Group III base stocks and wax isomerate base stock is at least 30 weight percent of the lubricating oil composition.

7. The lubricating oil composition of claim 6 wherein the amount of Group II base stock Group III base stocks and wax isomerate base stock is at least 50 weight percent of the lubricating oil composition.

8. A method of obtaining viscosity index enhancement in a lubrication composition comprising the step of adding the following to the lubricating composition:

(i) an alkylated naphthalene which contains at least about 5% of its weight from the naphthenoid moiety and having a viscosity of about 3 to about 50 cSt at 100° C.; and (ii) an olefinic oligomer of about 2,000 to about 20,000 number average molecular weight and having a viscosity of about 100 to about 3,000 cSt at 100° C.;

wherein the weight ratio of component (a) to component (b) is from about 1.5:1 to about 10:1, the amount added being from about 3% to 40% based on the weight of the lubricating composition.

9. A method of obtaining enhanced high-temperature high-shear (HTHS) viscosity performance of a lubricating composition comprising the step of adding the following to the lubricating composition:

(i) an alkylated naphthalene which contains at least about 5% of its weight from the naphthenoid moiety and having a viscosity of about 3 to about 50 cSt at 100° C.; and (ii) an olefinic oligomer of about 2,000 to about 20,000 number average molecular weight and having a viscosity of about 100 to about 3,000 cSt at 100° C.;

wherein the weight ratio of component (a) to component (b) is from about 1:2 to about 50:1, the amount added being from about 3% to 40% based on the weight of the lubricating composition.

10. A method of making lubricant composition rheological properties more Newtonian comprising the step of adding the following to the lubricating composition:

(i) an alkylated naphthalene which contains at least about 5% of its weight from the naphthenoid moiety and having a viscosity of about 3 to about 50 cSt at 100° C.; and (ii) an olefinic oligomer of about 2,000 to about 20,000 number average molecular weight and having a viscosity of about 100 to about 3,000 cSt at 100° C.;

wherein the weight ratio of component (a) to component (b) is from about 1:2 to about 50:1, the amount added being from about 3% to 40% based on the weight of the lubricating composition.

11. A method of obtaining viscosity index enhancement in a low-phosphorus, low-ash, paraffinic lubrication composition comprising the step of adding the following to the lubricating composition:

(i) an alkylated naphthalene which contains at least about 5% of its weight from the naphthenoid moiety and having a viscosity of about 3 to about 50 cSt at 100° C.; and (ii) an olefinic oligomer of about 2,000 to about 20,000 number average molecular weight and having a viscosity of about 100 to about 3,000 cSt at 100° C.;

wherein the weight ratio of component (a) to component (b) is from about 1:2 to about 50:1, the amount added being from about 3% to 40% based on the weight of the lubricating composition.

* * * * *